United States Patent [19]

Becker

[11] Patent Number: 4,867,832

[45] **Date of Patent: * Sep. 19, 1989**

[54] PORTABLE LABELING MACHINE

[76] Inventor: Werner Becker, Heinrich-Weiss-Str. 13, D-6932 Hirschhorn, Fed. Rep. of Germany

[ * ] Notice: The portion of the term of this patent subsequent to Apr. 24, 2001 has been disclaimed.

[21] Appl. No.: 160,849

[22] Filed: Feb. 26, 1988

[30] Foreign Application Priority Data

Mar. 2, 1987 [EP] European Pat. Off. ..... 87810113.8

[51] Int. Cl.[4] ..... B41J 5/00; B44C 7/00; B41F 1/08

[52] U.S. Cl. ..... 156/387; 156/577; 101/291; 101/316; 400/167

[58] Field of Search ..... 101/288, 291, 316, 292, 101/93.02; 400/167, 435, 457, 169, 166, 57.3; 156/540, 541, 277, 384, 387, 577, 582

[56] References Cited

U.S. PATENT DOCUMENTS

| | | | |
|---|---|---|---|
| 1,064,674 | 6/1913 | Ursbruck | 400/457 |
| 3,143,064 | 8/1964 | Vann | 101/93.02 |
| 3,734,262 | 5/1973 | Doll et al. | 400/457 |
| 4,018,154 | 4/1977 | Matsumoto et al. | 101/93.02 |
| 4,149,462 | 4/1979 | Sato | 101/291 |
| 4,206,703 | 6/1980 | Sato | 101/291 |

FOREIGN PATENT DOCUMENTS

| | | | |
|---|---|---|---|
| 1524082 | 1/1970 | Fed. Rep. of Germany | 400/435 |
| 48607 | 7/1986 | Japan | 400/435 |

*Primary Examiner*—Michael W. Ball
*Assistant Examiner*—Louis Falasco

[57] ABSTRACT

The machine comprises a print-head (3) for printing characters on labels (11) which are borne by a strip (10) which passes over a print-platen (8). In order to prevent, in reliable, rapid and space-saving manner, a second printing as a result of a rebound of the head (3) on the platen (8), this machine comprises: a lever (35) having two arms forming a V (36, 37) of alternate angular movement synchronized with the movements of the head (3), with dihedral (40) of elasitc return, pivoted in the platen (8) and urged alternately in one direction and the other by a pusher (30) which is integral with the head (3) and by a retraction arm (43) which is integral with an inking device (25, 26, 27) for preventing the return of the head (3) as the result of a rebound, by engagement of an arm (36) in a detention notch (32-33) which is integral with the head (3).

6 Claims, 2 Drawing Sheets

PORTABLE LABELING MACHINE

The present invention relates to a portable labeling machine which can be operated by a single hand, adapted to be loaded with a roll of detachable self-adhesive labels arranged one behind the other on a continuous strip, to print selected characters on such labels, to detach the labels from the strip and to adhere them one by one as they are printed onto articles which are intended for sale.

A labeling machine capable of carrying out these operations is already known, it being described in European Pat. No. 0 058 350 B1, which has certain arrangements in common with the machine of the present invention.

These two machines have the fact in common that they each have a housing provided with a carrying handle, a printing unit located in the housing and having at least one print-head with type selector and a print-platen which are adapted to come together for the striking of selected characters, a step-by-step drive device for driving a continuous label-bearing strip along a path passing over the print-platen, a trigger connected to the printing unit and to the step-by-step drive device to cause alternately upon each actuation thereof the typing of the selected characters on a label and upon each release the moving apart of the two elements of the printing unit and the advance of the continuous strip by one step, an inking device for the selected characters adapted to be placed alternately in retracted condition and in inking condition in synchronism with the respective movements towards and away from each other of the two elements of the printing unit, a detention device adapted to prevent a second printing of the selected characters caused by rebound resulting from the coming together of the two elements of the printing unit before the release of the trigger and comprising, on at least one side of the two elements of the printing unit, on the one hand a pusher, a lateral stop and at least one detention notch fixedly arranged on one of the two elements of the printing unit, and on the other hand on the other element of the printing unit a sequentially operated rotary detention member synchronized with the relative movements of the elements of the printing unit and called into action by the pusher, having a return element subjected to the pressure of a spring, and adapted to come to rest against the lateral stop under the action of the pusher upon the typing of the selected characters and to be inserted into the detention notch during the said rebound, and a device for separating and dispensing the labels from the continuous strip to the outside of the housing so as to permit their adhesive attachment to the articles to be labeled.

In said known machine, the rotary member of the detention device comprises, on its periphery, three equidistant cocking control fingers intended to be actuated selectively and sequentially by the pusher upon the typing and to come successively against the lateral stop and into the detention notch respectively. The return element of this rotary member is formed of a prism which is coaxial to the said rotary element and the polygonal contour of which has three edges each corresponding to one of the three cocking control fingers.

Upon each typing of characters, that is to say upon each coming together of the two elements of the printing unit, the pusher encounters one of the three cocking fingers of the rotary detention device and causes the latter to turn until the following cocking finger encounters the lateral stop, ready to engage in the detention notch in case of rebound under the push of the spring. Upon the release of the trigger, the spring causes the rotary member to turn so as to release the following cocking control finger from the detention notch and present it, in its turn, upon the next striking, to the action of the pusher. The rotary member thus presents to the action of the pusher, stroke after stroke and one after the other, its three cocking control fingers by repetitive rotation in the same direction of 120° each.

By this arrangement of the detention device, the said known machine makes it possible reliably to solve the problems of double printing and over-inking related to the phenomenon of rebound resulting from the encounter of the two elements of the printing unit before the release of the trigger, and this due to the fact that a rigid space element formed by a rotary member finger is introduced between these two elements of the printing unit immediately after said rebound.

The reliability of this detention device is also dependent upon its resistance to external actions caused by the handling of the apparatus in the course of labeling and upon the rapidity of response of the rotary member to the actions of the pusher and to the pressure of the spring during the approach of the two elements of the printing unit which causes the striking of the characters and until the time of rebound.

This operating phase during which the rotary member must turn slightly less than 120° and at the end of which one of its fingers must engage in a detention notch due to the pressure of the spring alone is in fact very short, particularly in machines in which the striking is effected by instantaneous release of a spring which is pretensioned during the actuating stroke of the trigger.

In the search for even greater reliability, the present invention relates at the same time to an increase in the resistance of the detention device to external acts and an increase in the rapidity of response of its rotary detention member, for all equal functional constraints applied to its elements.

For this purpose, the machine in accordance with the invention is characterized by the fact that the rotary detention member is a lever comprising a first arm and a second arm forming a V;

this lever is pivoted at its apex and its angular displacement is alternative;

the return element is a cam forming a dihedral integral with said lever, said dihedral being subjected to the permanent bias of the spring and its ridge defining the tilting position of said lever between a first angular position and a second, different angular position;

in the first angular position of the lever, its first arm is in raised waiting position oriented towards the other element of the printing unit while its second arm is in lowered retracted position;

in the second angular position of the lever its first arm is in retracted position while its second arm is in raised waiting position on the trajectory of the pusher;

a retraction arm of the first arm of the lever is mounted movable in the housing, the movement of this retraction arm being alternate and synchronized by mechanical liaison to the towards and away movements of the two elements of the printing unit;

during the movement of the two elements of the printing unit towards each other, the retraction arm moves in one direction, encounters the first arm of the lever and pushes said first arm from its raised waiting position towards its lowered retracted position, which results in pivoting the lever from its first angular position to its second angular position;

before the two elements of the printing unit encounter each other, the pusher encounters the second arm of the lever and pushes this second arm from its raising waiting position towards its lowered rest position, which has the effect of causing the lever to pivot in opposite direction from its second angular position towards its first angular position and of pivoting the first arm of said lever until it encounters the lateral stop against which it is held in waiting position of elastic engagement in the detention notch until the two elements of the printing unit come together, it being ready to engage in said detention notch in case of rebound as a result of said encounter, by the action of the spring on the ridge of the dihedral;

and during the movement apart of the two elements of the printing unit as a result of the release of the trigger, the action of the spring on the ridge of the dihedral completes the turning of the lever up to its first angular position while the retraction arm moves in an opposite direction, encounters the first arm and pushes it beyond its raised waiting position, which has the effect of pivoting the lever beyond its first angular position and against the action of the spring on the dihedral until said first arm yields passage to the retraction arm, whereupon the lever returns in the opposite direction to again resume its first angular position under the action of the spring on the dihedral.

In this way, by the V shape of lever imparted to the rotary detention member, which thus has only two arms instead of a minimum of three, and by the manner of alternate angular displacement based on passage from one angular position to the other and vice versa, in each of which one of these two arms is always retracted and the other always oriented in raised position towards the element of the printing unit which is opposite it, the invention responds well for the purpose in view.

In fact, there is thus never any standing of an arm of the rotary detention element in position protruding to the outside of the assembly of the two elements of the printing unit and therefore close to or substantially flush with the limits of the housing of the machine in a generally open area exposed to outside attack, as, in particular, below the printing platen which is at a place that may encounter a hard object upon the affixing of a label, such as, for instance, a can of canned food of angular contour.

The resultant reduced conformation of the rotary detention member formed by this V lever also affords the advantage of taking up less space, which is an appreciable advantage for the design of this type of machine in which room is always lacking to place all the indispensable functional structures within a minimum amount of space.

Finally, the elimination on the rotary member of one arm out of three offers, all proportions and all stresses applied in particular to this rotary member of the detention device being equal, an appreciable gain with respect to its weight and therefore its inertia and therefore by redundance with respect to its speed of response to the urging of the pusher and to the pressure of the spring during the very brief phase of typing the selected characters on a label.

BRIEF DESCRIPTION OF THE DRAWINGS

The accompanying drawing shows, by way of example, one embodiment of the object of the invention as well as a variant of one of its elements.

DETAILED DESCRIPTION OF THE PREFERRED EMBODIMENT

Figures 1, 7:
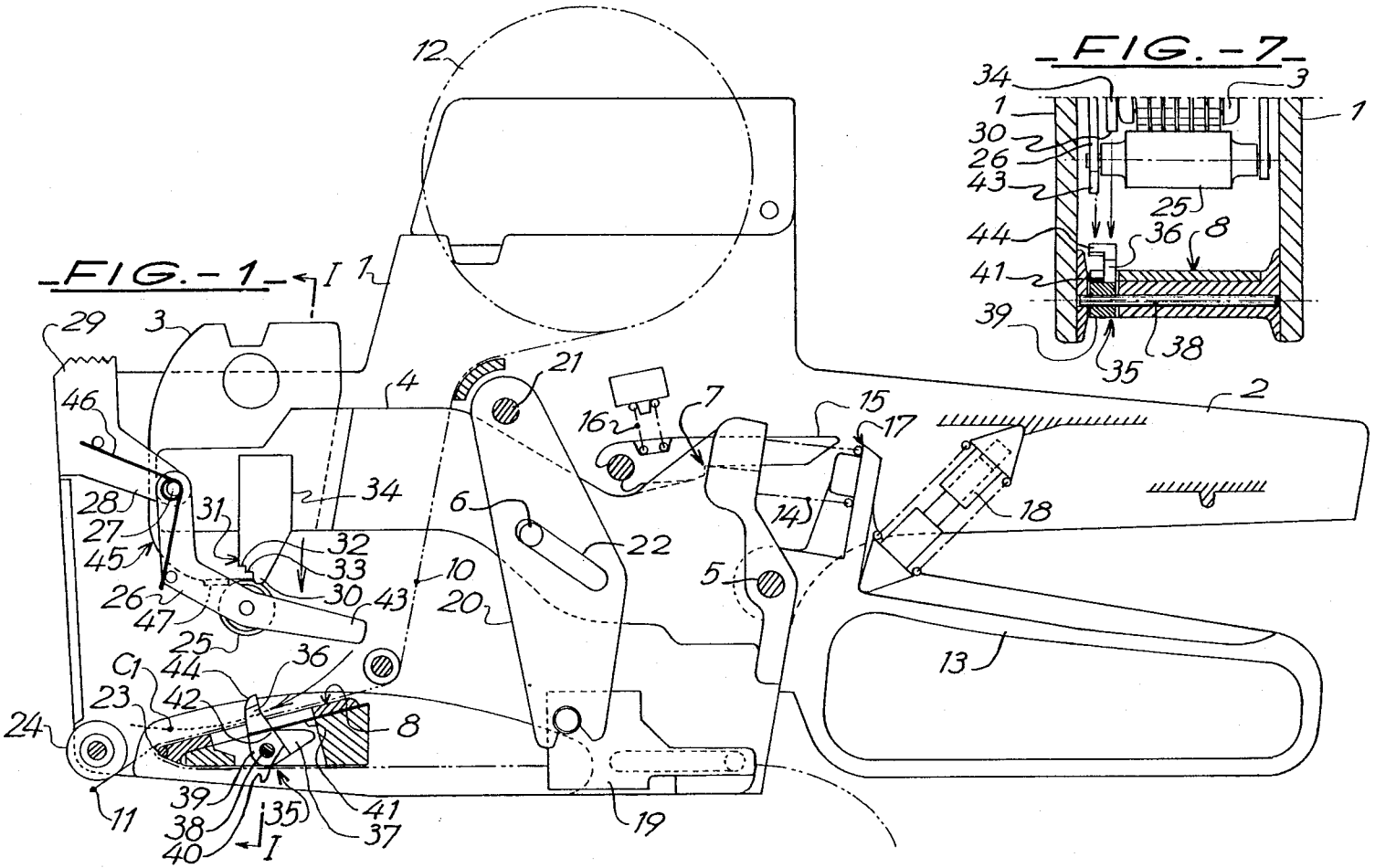
FIG. 1 is an overall view of the object of the invention in position of rest.
FIG. 7 is a partial section along the section axis I—I of FIG. 1.

The portable labeling machine comprises, as shown in its overall view in FIG. 1:

a housing 1 provided with a carrying handle 2;

a printing unit contained in the housing 1 and comprising here a single print-head 3 with integrated character selector, the print-head being fastened to the end of a first lever 4 which is articulated on a first pivot 5 and comprises a drive finger 6 and a stop notch 7, and a stationary print-platen 8 over which there passes the course of a continuous strip 10 of self-adhesive labels 11 coming from a roll 12 contained in the upper part of the housing;

a trigger 13 articulated on the first pivot 5, here of known type assisted by uniform pressure by release, the combined action of which is assured by a cocking spring 14, an escape pawl 15 with return spring 16 engaged in position of rest in the stop notch 7, and by a releaser 17 which is integral with the trigger 13 and intended to liberate this action by release of the pawl 15 from out of the notch 7; a spring spreader 18 is provided to bring this mechanism back into position of rest;

a step-by-step drive device 19 for the continuous strip 10, operated by a second lever 20 articulated to a second pivot 21 and having an oblique slot 22 in which there is engaged the drive finger 6 of the first lever 4; this device 19, which is imparted a reciprocating movement upon each actuation and relaxation of the trigger 13, has the known function of advancing the continuous strip 10 by a length corresponding to that of one label upon each step;

a device for the inking of the printing characters of the print-head 3, formed here by a retractable inking roller 25 borne by a double lever 26 with spring return articulated on both sides of the printing unit and outside of it on two pivots 27 borne by two side brackets 28 which are integral with a support 29 connected to the housing 1, a single lever 26, a single pivot 27 and a single bracket 28 being visible in the drawing; and a device for the separating and distributing of the labels 11 borne by the continuous strip 10 formed by the association of a hairpin-curved end 23 of the print-platen 8 the function of which is to separate the labels from the continuous strip and by a pressing roller 24 which makes it possible to adhere said labels by pressure of the machine on the article to be labeled.

These mechanisms of known type, aside however from the special function of the inking device 25, 26, 27, 28 and 29 which will be described further below, are supplemented by a detention device specific to the invention and which is intended to prevent a second printing of characters on the labels by return of the print-head as a result of the phenomenon of rebound referred to at the start hereof. This device, which is subject to variations which will be explained further below, comprises objects which are distributed over the two elements of the printing unit and an object separate from them and which are:

a pusher 30, a lateral stop 31 and two detention notches 32 and 33 formed here by the lower contour of a flat part 34 attached and fastened on the lever 4 on one side of the print-head 3 opposite the print-platen 8, a rotary detention member formed by a lever 35 bearing a first arm 36 and a second arm 37 forming a V, pivoted at its apex on a pivot 38 integral with the print-platen 8 and with alternate angular displacement the plane of rotation of which is perpendicular to the said print-platen 8 and extends in the direction of the length thereof. This lever 35, also shown in FIGS. 7 and 8, has a return element which is integral with it and which is formed by a cam 39 forming a dihedral 40 subjected tangentially to the permanent pressure of a leaf spring 41 fastened to the print-platen 8 and the ridge 42 of which defines the position of tilt of said lever under the pressure of the spring 41 between a first angular position of rest corresponding to that shown in FIG. 1 and a second angular position of rest corresponding to that shown in FIG. 2, these two angular positions being explained further below, a retraction arm 43 of the first arm 36 of the lever 35 with elastic return which is formed here by an extension of one of the two side levers 26 of the inking device but which could without drawback be independent of the latter, as will be shown further below by the description of the variant shown in FIG. 6.

Figure 8:
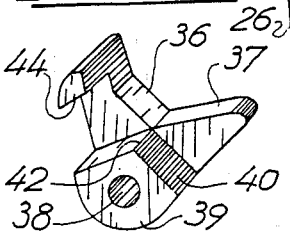
FIG. 8 is a view in perspective of an element of the invention.

From FIG. 8 it is clear that the first arm 36 and the second arm 37 of the lever 35 are located in the same plane situated, as shown in FIG. 7, in alignment with 34 having the pusher 30, and it is also evident from these same figures that the first arm 36 has at its end a lateral extension 44 located in the plane of pivot of the retraction arm 43.

On its part, the inking device which bears the retraction arm 43 is synchronized with the alternate movements towards and away from each other of the two elements of the printing unit, that is to say here with the effective movements of the print-head 3, by a mechanical connection comprising in this case a cam 45 formed by the contour of the print-head 3 located on its side and by the inking roller 25 itself which is maintained pressed elastically against said contour by a return spring 46. Geometrically, the location of the pivot 27 of the lever 26 bearing both the inking roller 25 and the retraction arm 43 and the lever arms separating these three elements are provided so that during the lowering of the print-head 3 the inking roller 25 passes over the printing characters 47 and then retracts from the path of the said print-head while the end of the retraction arm 43 passes above and in the vicinity of the print-platen 8 over a sufficient length to encounter the lateral extension 44 of the first arm 36 of the lever 35.

Figure 2:
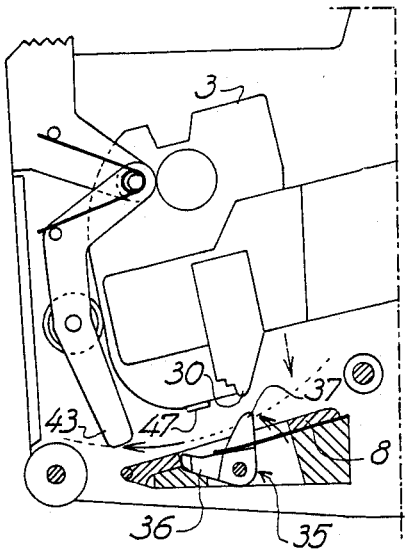
FIGS. 2, 3, 4 and 5 are four partial views each showing one step in its operation.
Figure 3:
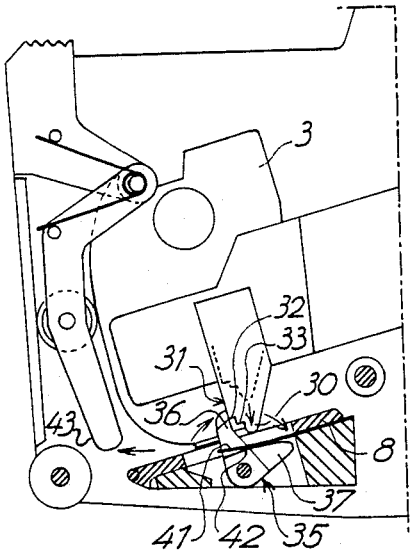
Figure 4:
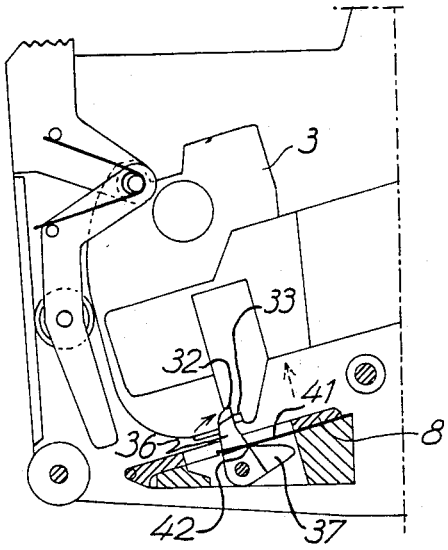
Figure 5:
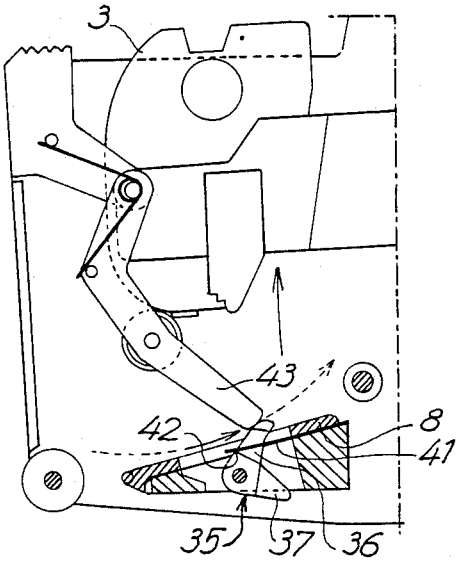

The operating conditions of the detention device which has just been described will be evident from the following:

in the first angular position of the lever 35, corresponding to FIG. 1, its first arm 36 is in raised waiting position oriented towards the other element of the printing unit, while its second arm 37 is in lowered retracted position in the print-platen 3, the machine being in position of rest, in the second angular position of the lever 35, corresponding to FIG. 2, its first arm 36 is in retracted position in the print-platen 3'while its second arm 37 is in raised waiting position on the path of the pusher 30 integral with the print-head 3, during the movement of relative approach of the two elements of the printing unit to each other, that is to say here during the lowering of the print-head 3 as a result of the actuation of the trigger 13, the retraction arm 43 moves in a direction indicated by the circular arc C1 (FIG. 1) under the effect of the push of the cam 45 on the inking roller 25, encounters the first arm 36 at the level of its side extension 44 and pushes this first arm from its raised waiting position towards its retracted position, which has the effect of causing the lever 35 to pivot from its first angular position in accordance with FIG. 1 to its second angular position in accordance with FIG. 2, before the two elements of the printing unit come together, that is to say the print-head 3 with the print-platen 8, in a phase which is between those shown in FIGS. 2 and 3 and which precedes the typing of the characters 47 on a label of the strip 10, the pusher 30 encounters the second arm 37 of the lever 35 and pushes this second arm from its raised waiting position according to FIG. 2 towards its lowered rest position, which has the effect of causing the lever 35 to pivot in opposite direction from its second angular position according to FIG. 2 and of causing the first arm 36 of said lever to pivot until it encounters the lateral stop 31 against which it is held in elastic waiting engagement in a detention notch 32 or 33 until the encounter of the two elements of the printing unit, in accordance with FIG. 3, ready to engage in one of the two detention notches in case of rebound as a result of this encounter, and this by the action of the spring 41 on the ridge 42 of the dihedral, as shown in FIG. 4, during the movement apart of the two elements of the printing unit, that is to say here during the rising of the print-head as a result of the release of the trigger 13, the action of the spring 41 on the ridge 42 of the dihedral completes the turning of the lever 35 into its first angular position in a phase between those shown in FIGS. 4 and 5, while the retraction arm 43 moves in an opposite direction, in the phase shown in FIG. 5, encounters the first arm 36 and pushes it beyond its raised waiting position, which has the effect of for a very short time pivoting the lever 35 beyond its first angular position and against the action of the spring 41 on the dihedral 40 until this first arm 36 yields to the passage of the retraction arm 43, after which the lever 35 returns in opposite direction to resume its first angular position of rest in accordance with FIG. 1 under the action of the spring 41 on the dihedral 40.

The machine is thus again in the initial position of rest in accordance with FIG. 1, ready for a new operating cycle.

Figure 6:
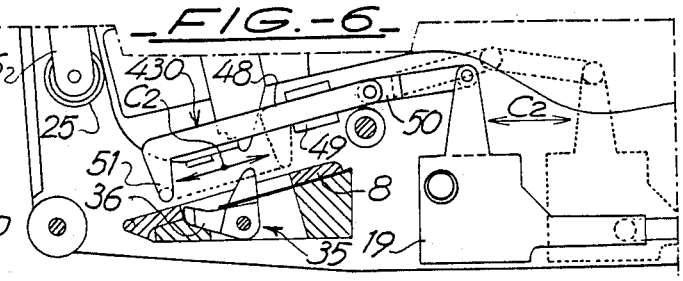
FIG. 6 is a partial view of the variant.

In the variant shown in FIG. 6, only the retraction arm 430 and the mechanism for the synchronization of its alternating displacement with the movements towards and away from each other of the two elements of the printing unit are different from their homologs of the detention device which has just been described.

This retraction arm 430 has a linear alternate displacement and for this purpose has a linear part 48 guided in translation in a slot 49 integral with a side wall of the housing 1, connected here by a connecting rod 50 to the step-by-step drive device 19 for the continuous strip 10.

The end of this retraction arm 430 opposite the connecting rod 50 has a finger 51 which is offset towards the print-platen 8 and the linear path of which crosses that of the first arm 36 of the lever 35 substantially in the same region and in order to assure the same functions as the retraction arm 43 previously described, but its shorter stroke is, however, sufficient and corresponds to the stroke of the aforementioned device 19 which is indicated by the arrows C2.

The connecting mechanism which assures the alternating displacement of this retraction arm comprises, as can be noted from FIG. 1, the chain of elements which is formed of the connecting rod 50, the step-by-step advancing device 19 and the lever 20 for the control of the latter.

From FIG. 6 which shows an operating phase corresponding to FIG. 2, there will be noted the presence of the inking roller 25 and of the truncated end of its lever 26, which clearly shows that the retraction arm is not necessarily connected to an inking device and that the latter may therefore be of any other design.

It is also possible to provide, in a variant which is not shown but is easily conceivable, both a pivoting inking device, for example like the one shown in European Pat. No. 0 058 350 cited at the beginning hereof, and a retraction arm pivoting in the manner of the arm 43 described here of linear shape directly articulated without elbow to a pivot which would be integral with a side wall of the housing 1.

Likewise, other connecting mechanisms than those shown can be applied for the synchronizing of the alternating displacement of the retraction arm 43 or 430 with the movements towards and away from each other of the two elements of the printing unit, provided that a stroke comparable to the strokes C1 or C2 is obtained.

Of course, the concept of the invention is not limited to its application to a machine of the type described the print-head 3 of which is movable and the print-platen 8 stationary; it can also be applied to machines in which this arrangement is reversed, as well as to machines in which both elements of the printing unit are mobile.

The detention device can be doubled, that is to say arranged on both sides of the printing unit, the second lever 35 mounted, for instance, on the same shaft 38 so as to compensate for any possible defect in natural or elastic transverse parallelism between these two elements, in the case, for instance, of a selection of a very small distance between the two elements of the printing unit in detention position after a rebound.

Finally, the invention can obviously be applied to machines in which the printing unit has more than one print-head.

I claim:

1. A portable labeling machine comprising a housing (1) providing with a carrying handle (2), a printing unit located in the housing and having at least a printhead (3) with type selector and a print-platen (8), said printhead and said print-platen being adapted for relative movement therebetween towards each other for the typing of selected characters and for subsequent relative movement away from each other, a step-by-step drive device (19) for advancing a continuous label-bearing strip (10) along a circuit passing over the print-platen, a lever-shaped trigger (13) connected to the printing unit and to the step-by-step drive device to cause alternatively upon each actuation thereof the typing of the selected characters on a label and upon each release thereof the movement of the two elements of the printing unit away from each other and the advancing of the strip by one step, an inking device for the selected characters adapted to be put alternatively into retracted condition and into inking condition in synchronism with the movements towards and away from each other of the two elements of the printing unit, a rotary detention device adapted to be opposed to a second printing of characters upon rebound resulting from the movement of the two elements of the printing unit towards each other before release of the trigger and comprising, at least on one side of the two elements of the printing unit, on the one hand a trajectory pusher, a lateral stop and at least one detention notch fixedly arranged on one of the two elements of the printing unit, and on the other element of the printing unit a sequentially operated rotary detention member synchronized with the relative movements of the elements of the printing unit and called into action by the pusher, having a return element subjected to pressure of a spring, and adapted to come into rest against the lateral stop upon calling into action by the pusher upon typing of the selected characters and to be inserted into the detention notch during the said rebound, and a device (23, 24) for separating and dispensing the labels of the continuous strip towards the outside of the housing to permit adhesive attachment thereof to items to be labeled, characterized in that:

the rotary detention member is a V-shaped lever (35) comprising a first arm (36) and a second arm (37);

this lever is pivoted at its apex to alternate first and second angular positions;

the return element is a cam forming a dihedral (40) integral with said lever, said dihedral being subjected to the pressure of the spring (41), said dihedral comprising a ridge (42) defining the tilting position of said lever between a first and a second angular positions which are different from each other;

in the first angular position of the lever its first arm (36) is in the raised waiting position oriented towards the other element of the printing unit while its second arm (37) is in lowered retracted position;

in the second angular position of the lever its first arm (36) is in retracted position while its second arm (37) is in raised waiting position on the trajectory of the trajectory pusher (30);

a retraction arm (43, 430) for the first arm (36) of the lever is mounted movable in the housing, the motion of this retraction arm being alternative and synchronized by mechanical liaison to the respective movements of the two elements of the printing unit towards and apart from each other;

during the towards each other movement of the two elements of the printing unit the retraction arm (43, 430) moves in one direction, encounters the first arm (36) of the lever and pushes this first arm from its raised waiting position towards its lowered retracted position, which results in the pivoting of the lever from its first angular position to its second angular position;

before the encounter of the two elements of the printing unit the pusher (30) encounters the second arm (37) of the lever and pushes that second arm from its raised waiting position towards its lowered rest position, which results in the pivoting of the lever in opposite direction from its second angular position towards its first angular position and in the pivoting of the first arm (36) of said lever up to its encounter with the lateral stop (31) against which it is maintained in waiting position for resilient engagement into the detention notch (32) up to the encounter of the two elements of the printing unit, ready to engage into said detention notch in case of rebound following said encounter, by the action of the spring (41) on the ridge (42) of the dihedral;

and upon movement apart of the two elements of the printhead following release of the trigger the action of the spring on the ridge (42) of the dihedral completes rotating the lever up to its first angular position, while the retraction arm (43, 430) moves in an opposite direction, encounters and pushes the first arm (36) beyond its raised waiting position, which results in the pivoting of the lever beyond its first angular position against the action of the spring on the dihedral (40) up to this first arm gives way to the retraction arm (43, 430), after which the lever returns back in opposite direction to take again its first angular position under the action of the spring on the dihedral.

2. A machine according to claim 1, characterized in that the retraction arm (43) is mounted movable in the housing by pivoting around a pivot (27), its active stroke being thus an arc of circle (C1).

3. A machine according to claim 2, characterized in that the retraction arm (43) is formed by a lever (26) of the inking device.

4. A machine according to claim 3, characterized in that the mechanical liaison, for synchronization of the alternative movements of the retraction arm (43) with the movements towards and away of each other of the two elements of the printing unit, comprises a cam (45) supported by one of these two elements and on which is resiliently pressed by a spring (46) a rotating guide member (25) for the pivoting of said retraction arm (43) integral therewith.

5. A machine according to claim 1, characterized in that the retraction arm (430) is mounted movable in the housing by translation into a slide (49), its active stroke being thus a straight line (C2).

6. A machine according to claim 5, characterized in that the mechanical liaison, for synchronization of the alternative movements of the retraction arm (430) with the movements towards and away of each other of the two elements of the printing unit, comprises a rod (50) articulated on the one hand to the retraction arm (430) and on the other hand to the step by step drive device (19) of the continuous label strip.

* * * * *